United States Patent [19]

McMahon

[11] 3,977,582

[45] Aug. 31, 1976

[54] BLACK JACK HOLDER

[76] Inventor: Robert J. McMahon, 1105 Brennan Drive, Warminster, Pa. 18974

[22] Filed: Mar. 24, 1975

[21] Appl. No.: 561,471

[52] U.S. Cl. ..... 224/1 R; 224/26 B

[51] Int. Cl.[2] ..... A45C 11/00

[58] Field of Search ..... 224/5 A, 5 R, 2 B, 2 D, 224/2 E, 2 F, 26 R, 26 B, 1 R

[56] References Cited

UNITED STATES PATENTS

| | | | |
|---|---|---|---|
| 1,605,195 | 11/1926 | Lewis | 224/26 K X |
| 3,130,883 | 4/1964 | MacKool | 224/5 A |
| 3,531,031 | 9/1970 | Angell | 224/2 B |
| 3,533,540 | 10/1970 | Carinci | 224/2 D |
| 3,854,639 | 12/1974 | Genchi | 224/2 E X |
| 3,870,208 | 3/1975 | Theodore | 224/2 F |

OTHER PUBLICATIONS

Popular Mechanics, Craft Project, One–Piece Knife Sheath, P.N.R. 1088.

*Primary Examiner*—Robert J. Spar
*Assistant Examiner*—Jerold M. Forsberg
*Attorney, Agent, or Firm*—Zachary T. Wobensmith, 2nd; Zachary T. Wobensmith, III

[57] ABSTRACT

A black jack holder of one piece construction is disclosed which provides a housing for the end of a black jack and flaps for retaining the handle of the black jack, which flaps may have a strip of thistle cloth thereon to provide securement and easy release of the flaps, the holder being suitable for carrying various sizes and shapes of black jacks.

6 Claims, 7 Drawing Figures

FIG. 1
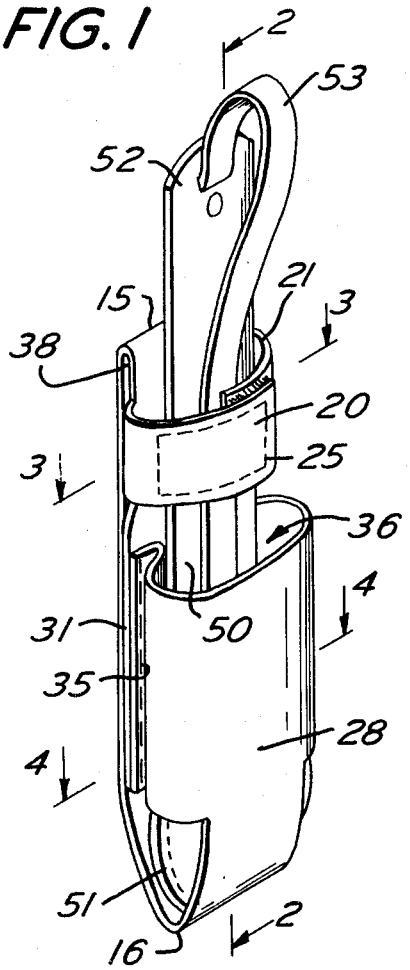
FIG. 2
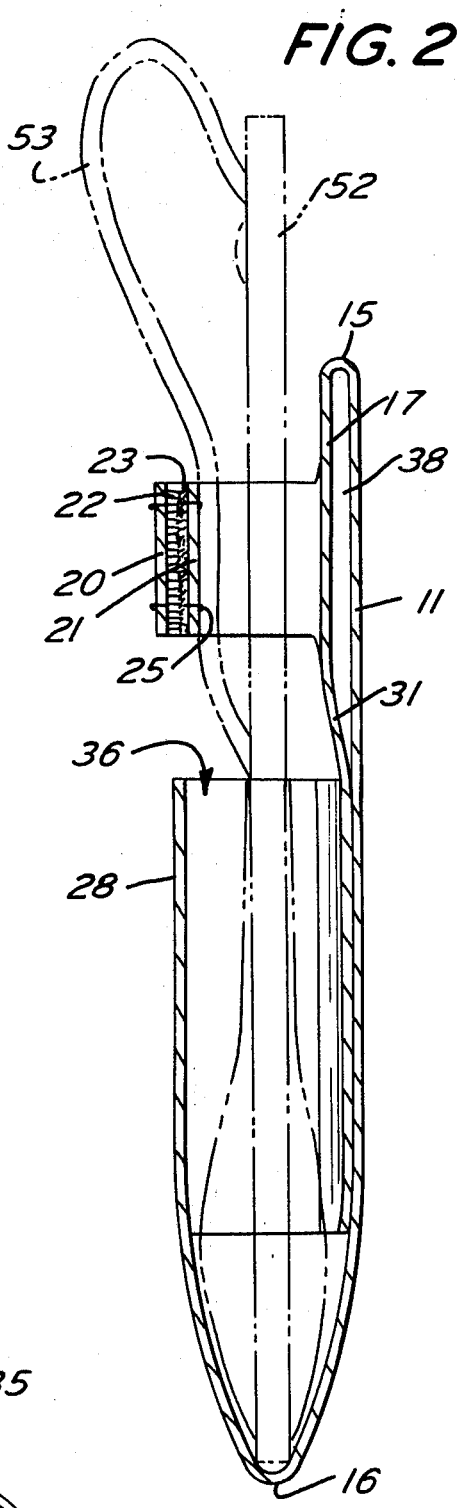
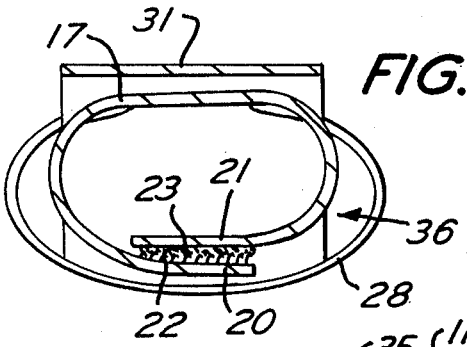
FIG. 3
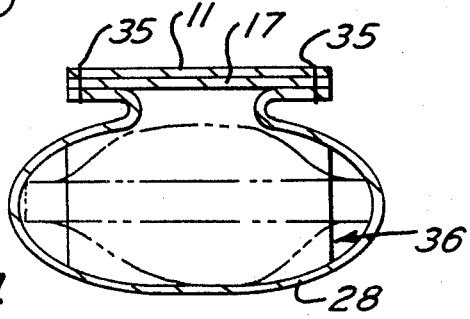
FIG. 4

FIG.5
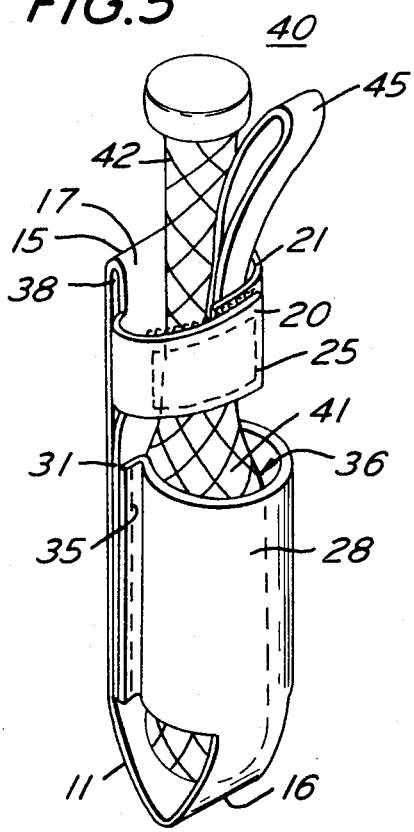
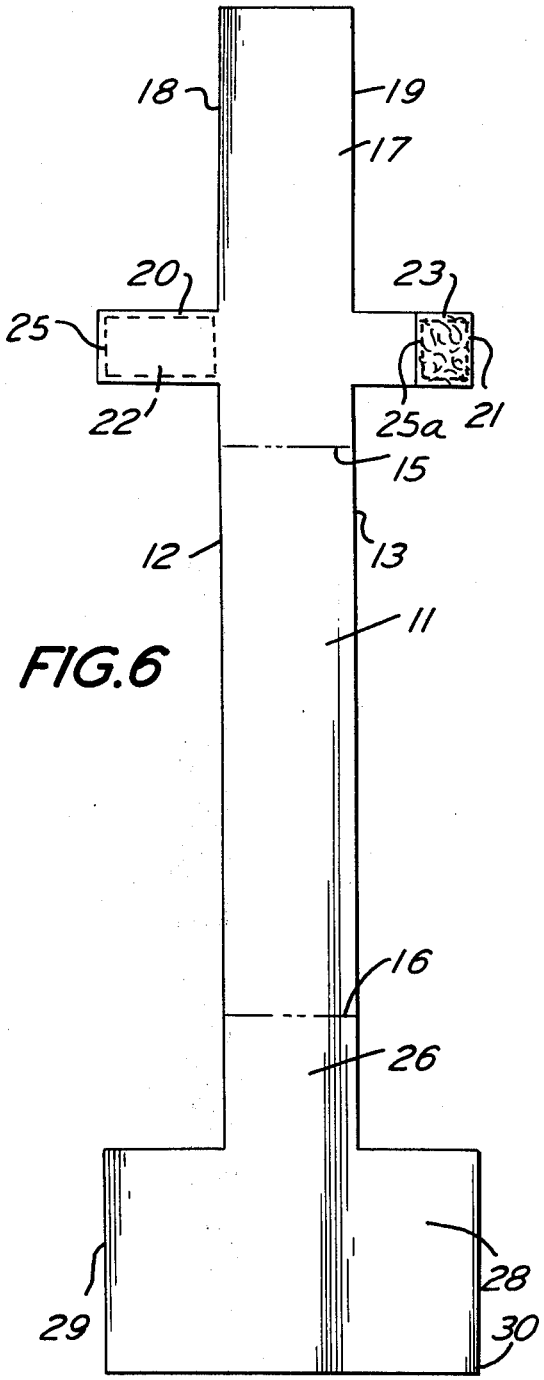
FIG.6
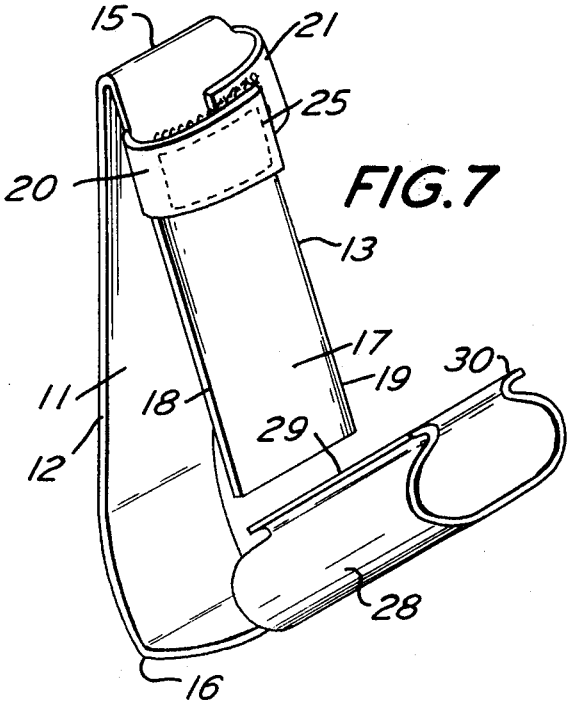
FIG.7

BLACK JACK HOLDER

BACKGROUND OF THE INVENTION

This invention relates to a black jack holder of the type which is constructed of one piece of material and with a housing that can accommodate various sizes and shapes of black jacks.

DESCRIPTION OF THE PRIOR ART

For many years peace officers have carried black jacks both on and off duty independently and as a supplement to a large wooden club or night stick which many carry on duty.

Holders for mounting on the belt to carry various tools and the like have heretofore been proposed but these are not satisfactory for carrying black jacks with quick removal.

Audley, in U.S. Pat. No. 710,236 shows a holder for policemen's clubs but this does not prevent excessive wear of the clothing and requires separation of a resilient ring or total vertical movement for removal of the club. No built in accommodation to varying types of clubs or the like is available.

Knife sheaths, such as shown by Griffis, U.S. Pat. No. 3,841,541 have been proposed but these are not suitable for carrying black jacks for quick removal.

Clay, in U.S. Pat. No. 3,637,120 shows a holster which includes overlapping flaps with a glove fastener but this structure is also wholly unsuitable for carrying a black jack.

The usual method of carrying black jacks has been to slip them into a pocket or between the trousers and the body at the waist. Such methods of carrying black jacks are very uncomfortable for the wearer as well as being insecure since the black jack may slip out of the wearers pocket upon entering or leaving patrol cars or at any time when rising from a seated position.

In addition, carrying of black jacks in front or rear trouser pockets usually results in the pockets or trousers at the pocket area wearing out in a very short time causing a not inconsiderable expense for trousers replacement.

The holder of my invention provides a convenient structure for carrying different types of black jacks both on and off duty with positive securing and easy accessibility of the black jacks when needed, and does not result in damage to the clothing of the wearer.

SUMMARY OF THE INVENTION

This invention relates to a black jack holder of one piece construction with a housing for the body of the black jack and readily separable flaps, preferably thistle cloth lined flaps, to retain the black jack handle, which holder may be carried on a belt worn by the wearer.

The principal object of the invention is to provide a black jack holder that provides positive retention of the black jack but easy access when desired.

A further object of the invention is to provide a black jack holder that can be worn both on and off duty.

A further object of the invention is to provide a black jack holder that will accept both round end and flat end black jacks and black jacks of different lengths.

A further object of the invention is to provide a black jack holder that is simple and inexpensive to construct but is sturdy and long lasting in service.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which:

FIG. 1 is a perspective view of a black jack holder of my invention and with a flat black jack in place;

FIG. 2 is a vertical sectional view, enlarged, taken approximately on the line 2—2 of FIG. 1;

FIG. 3 is a horizontal sectional view, enlarged, taken approximately on the line 3—3 of FIG. 1, but with the black jack removed;

FIG. 4 is a horizontal sectional view, enlarged, taken approximately on the line 4—4 of FIG. 1;

FIG. 5 is a view similar to FIG. 1 but illustrating the black jack holder with a round black jack in place;

FIG. 6 is a plan view of the blank which is folded and stitched to form the black jack holder of my invention, and FIG. 7 is a view in perspective of the black jack holder showing how the blank is assembled to provide the holder of my invention.

It should, of course, be understood that the description and drawings herein are illustrative merely and that various modifications and changes can be made in the structure disclosed without departing from the spirit of the invention.

DESCRIPTION OF THE PREFERRED EMBODIMENTS

Referring now more particularly to the drawings and FIG. 6 thereof a blank 10 is shown from which the black jack holder is assembled and is of generally rectangular configuration.

The blank 10 is preferably formed of leather, however, any suitable durable flexible material such as vinyl plastic could be used if desired.

The blank 10 includes a central rectangular panel 11 which has side edge margins 12 and 13 and top and bottom fold lines 15 and 16 which indicate where the blank 10 is to be folded to form the assembled holder.

The blank 10 above the fold line 15 has an additional panel 17 integral with central panel 11 which has side edge margins 18 and 19 and is provided with tabs or flaps 20 and 21 extending perpendicularly therefrom and shown as being of equal length.

The flaps 20 and 21 are of rectangular configuration with the flap 20 having a strip of thistle cloth 22 on one side which can mate with a strip of thistle cloth 23 on the opposite side of flap 21. The strip 22 is composed of thistle cloth hook material and the strip 23 is of thistle cloth pile material. Thistle cloth is widely used for fastening, is sold under the trademark "Velcro", and includes a strip of pile material and a strip of hook like material which may be easily engaged and disengaged many times without any appreciable wear but which when engaged is strongly resistant to shear but may be separated by force applied for perpendicular separation.

The strips 22 and 23 may be secured to the flaps 20 and 21 by a layer of adhesive (not shown) and lines of stitching 25 and 25*a*.

Below the fold line 16 an additional panel 26 is provided integral with central panel 11. The panel 26 has a panel 28 integral therewith which has side edge margins 29 and 30.

Referring to FIGS. 5 and 7, the blank 10 is assembled into the black jack holder by folding panel 17 down along fold line 15 and back against central panel 11 to form a main body member 31. The panels 26 and 28 are folded up along line 16 and the side edge margins 29 and 30 of panel 28 are aligned with the side edge margins 18 and 19 of panel 17 and the side edge margins 12 and 13 of panel 11. A line of stitching 35 on each side through the panels 28, 17 and 11 retains them together and forms a housing 36.

The panels 17 and 11 when folded together and above the upper termini of the lines of stitching 35 form a belt loop 38 therebetween at the upper portion of the main body member.

As shown in FIG. 5, a round black jack 40 may be placed in housing 36 and retained therein by engaging the cloth strips 22 and 23 to hold the flaps 20 and 21 in overlapped relation.

The black jack 40, which is of convenient type, includes a weighted end portion 41 which is carried in housing 36 and a handle portion 42 which is retained by the engagement of the flaps 20 and 21. A strap 45 extends from the black jack 40 for engaging around the hand of the user.

Referring now to FIGS. 1, 2, 3 and 4, the black jack holder of FIG. 6 is shown with a conventional type flat black jack 50 therein which has a weighted end portion 51 of considerably greater width than the end 41 of black jack 40 but is accommodated by the housing 36 which expands sidewards. The black jack 50 has a handle portion 52 and a strap 53 which engages around the hand of the user.

The black jack 50 is available in a variety of lengths, such as 8, 10 and 14 inches all of which are readily accommodated by housing 36 and can be retained by the engagement of flaps 20 and 21.

When it is desired to remove the black jack from the holder this may be readily accomplished by grasping the strap 53 and/or the handle 52, or by grasping the strap 45 and/or the handle 42 and sharply pulling to disengage the flaps 20 and 21. Quick removal of the black jack from the holder can readily be effected.

It will thus be seen that a black jack holder has been provided with which the objects of the invention are attained.

I claim:

1. A black jack holder of one piece construction to be worn on the belt of the user and having a unitary main body member which includes a lower horizontally and vertically flexible tubular housing open at the top for retention of black jacks of different shapes, said housing comprising a rear downwardly extending panel portion formed integrally with a front panel portion extending upwardly from the bottom thereof, said front panel portion having an upper part with a larger horizontal dimension than the lower parts of said front and rear panel portions, said upper part of said front panel portion connected to the upper part of said rear panel portion contiguous to the edges of said panel portions by spaced vertical lines of stitches terminating above the lower margin of said upwardly extending portion, the lower part of said rear panel portion and the lower part of said front panel portion being open at each side to allow for a change of shape of the housing to accommodate various sizes of black jack, said integral lower parts of said panel portions limiting downward movement of the black jack, said main body member having a pair of flaps in overlapping relation above said tubular housing, detachably engageable securing means on said flaps for releasably securing the overlapped flaps around a handle portion of the black jack for retaining the same in the housing, and said main body member having means for mounting said main body member on the belt of the user.

2. A black jack holder as defined in claim 1 which said securing means includes thistle cloth members on the meeting faces of said flaps.

3. A black jack holder as defined in claim 1 in which said mounting means is a loop.

4. A black jack holder as defined in claim 1 in which said holder is of leather.

5. A black jack holder as claimed in claim 1 in which said rear panel portion has immediately in front thereof an intermediate panel portion to which said aforementioned panel portions are secured by said lines of stitches.

6. A black jack holder as defined in claim 5 in which said rear panel portion and said intermediate portion are connected at their uppermost margins and provide said mounting means.

* * * * *